United States Patent [19]

Hayashi et al.

[11] Patent Number: 4,520,756

[45] Date of Patent: Jun. 4, 1985

[54] BUILD-UP SPRAYING APPARATUS

[75] Inventors: Mitsuji Hayashi, Tachikawa; Hideo Endo, Sagamihara; Hirotsugu Oishibashi, Musashino; Takeo Aichi, Kitakyushu; Shigeru Sasaki, Niiza, all of Japan

[73] Assignees: Japanese National Railways, Tokyo; Kyushu Tetsudo Kiki Mfg., Co., Ltd., Fukuoka, both of Japan

[21] Appl. No.: 622,716

[22] Filed: Jun. 20, 1984

[30] Foreign Application Priority Data

Jul. 20, 1983 [JP] Japan ..... 58-130867

[51] Int. Cl.[3] ..... B05B 7/16

[52] U.S. Cl. ..... 118/699; 118/47; 118/302; 118/305; 118/307; 239/85; 239/101; 239/102; 239/184; 239/297; 239/300

[58] Field of Search ..... 118/305, 307, 302, 47, 118/699; 239/85, 101, 102, 184, 186, 187, 296, 297, 300

[56] References Cited

U.S. PATENT DOCUMENTS 4,064,925 12/1977 Singer ..... 239/297 X

*Primary Examiner*—Evan K. Lawrence

*Attorney, Agent, or Firm*—Pearne, Gordon, Sessions, McCoy, Granger & Tilberry

[57] ABSTRACT

A build-up spraying apparatus is disclosed which is capable of positionally adjusting the spreading rate of build-up metal powder on an article along the spreading direction to satisfactorily carry out partial or local build-up as well as uniform build-up as desired. The build-up spraying apparatus includes a fluid control device for spreading build-up metal powder having a pair of control gas injection nozzles formed at the both sides of the interior thereof and a control gas switching cycle setting means for supplying two systems of control gas to the fluid control device at a predetermined cycle to positionally control the spreading rate of build-up metal powder in the spreading direction. The apparatus also includes at least one heating burner body for heating build-up metal powder ejected from the fluid control device, the heating burner body being adapted to vary the amount of heat according to the difference in injection rate of build-up metal powder in the spreading direction.

19 Claims, 14 Drawing Figures

BUILD-UP SPRAYING APPARATUS

BACKGROUND OF THE INVENTION

1. Field of the Invention

This invention relates to a build-up spraying apparatus, and more particularly to a build-up spraying apparatus particularly suitable for use in the repairing of local or partial wear of a metal article such as a rail by build-up spraying of metal powder.

2. Description of the Prior Art

Recently, a need has highly existed for techniques of efficiently repairing the local or partial wear of a rail without exchanging the rail. In order to meet such demand, it has been proposed to deposit metal powder on such wear portion of a rail by build-up spraying.

A conventional build-up spraying apparatus which has been used for such purpose includes a build-up spraying burner which is adapted to uniformly spread build-up metal powder together with carrier gas thereon toward an article to be subjected to build-up spraying and heat and melt the metal powder by flame ejected from the burner on the way to the article, to thereby uniformly deposit the molten metal powder on the surface of the article. The build-up portion of the article is subsequently ground by means of a grinder or the like to be flush with the remaining portion thereof.

As can be seen from the foregoing, the conventional build-up spraying burner is adapted to form build-up of a uniform thickness in the spreading direction of build-up metal powder perpendicular to the traveling direction of the apparatus. However, the burner cannot form build-up sufficient to repair wear different in depth with location such as the local wear or partial wear of a rail, because it carries out build-up spraying regardless of such local or partial wear. Thus, the repairing operation using the conventional build-up spraying apparatus is much troublesome, because an operation is indispensable which renders the built-up portion flush with the remaining portion after forming build-up.

BRIEF SUMMARY OF THE INVENTION

The present invention has been made in view of the foregoing disadvantage of the prior art.

Accordingly, it is an object of the present invention to provide a build-up spraying apparatus which is capable of selectively forming build-up different in thickness with location as well as that of a uniform thickness, as desired.

It is another object of the present invention to provide a build-up spraying apparatus which is capable of adjusting the amount of heat in view of the difference in spreading rate of build-up metal powder in the spreading direction, to thereby accomplish satisfactory melting of the metal powder.

It is a further object of the present invention to provide a build-up spraying apparatus which is capable of starting build-up spraying only by putting the apparatus on an article to be subjected to build-up spraying.

It is still a further object of the present invention to provide a build-up spraying apparatus which is capable of readily carrying out the installation and removal of the apparatus with respect to an article to be subjected to build-up spraying.

In accordance with the present invention, there is provided a build-up spraying apparatus comprising a truck adapted to travel on an article to be subjected to build-up spraying and a build-up spraying burner supported on said truck to carry out build-up spraying with respect to said article, wherein said build-up spraying burner comprises: a fluid control device for spreading build-up metal powder, said fluid control device being adapted to eject build-up metal powder together with carrier gas toward said article to spread build-up metal powder in the direction perpendicular to the traveling direction of said apparatus; a device for controlling the supply of control gas so as to alternately supply to the fluid control device two systems of control gas in a pulselike manner which act to positionally control the spreading rate of build-up metal powder in the spreading direction; and at least one heating burner body for heating build-up metal powder ejected from said fluid control device, said heating burner body being adapted to vary the amount of heat according to the difference in injection rate of build-up metal powder in the spreading direction.

In accordance with a preferred embodiment of the present invention, said fluid control device has a slit for spreading build-up metal powder therefrom formed therein and opened at the outlet thereof, said slit being formed to allow the width in the spreading direction to extend from the inlet thereof to the outlet thereof; a build-up metal powder injection nozzle for ejecting build-up metal powder into said slit provided at the inlet of said slit so as to be opposite to said slit; and a pair of control gas injection ports formed on the both sides of the inlet of said slit along the spreading direction of build-up metal powder to eject said two systems of control gas supplied from said control gas supply controlling device in a pulselike manner to positionally control the spreading rate of build-up metal powder in the spreading direction. Also, in a preferred embodiment of the present invention, said heating burner body is formed therein with a plurality of flame holes each of which is opened at the lower end thereof, said flame holes being arranged in a row in the spreading direction and connected thereto supply lines for fuel gas and combustion promoting gas which are provided with flow control valves. Furthermore, the control gas supply controlling device may comprise a means for varying the cycle, pulse width or gas pressure of each of said two systems of control gas.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same parts throughout the figures thereof, wherein.

DETAILED DESCRIPTION OF THE PREFERRED EMBODIMENT

Figure 1:
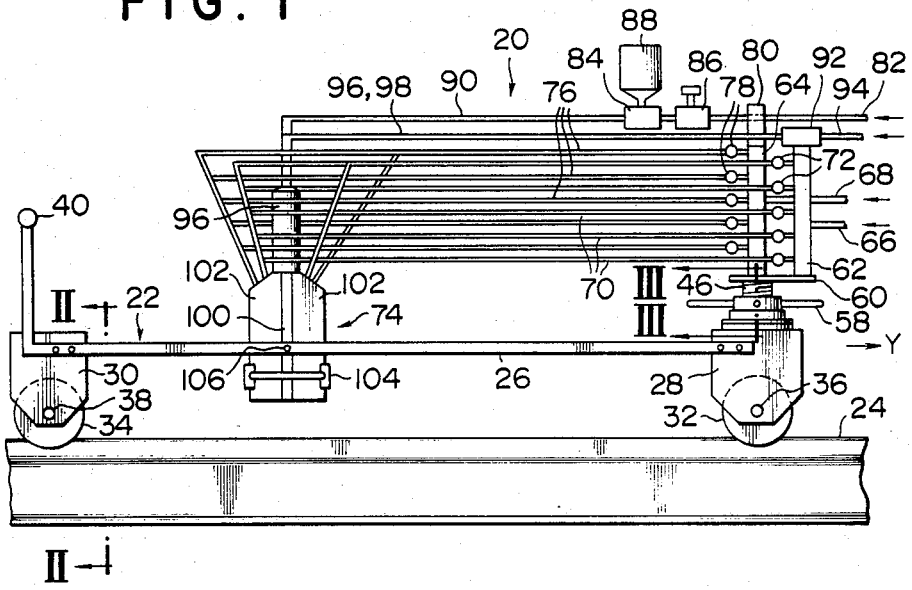
FIG. 1 is a side view showing an embodiment of a build-up spraying apparatus according to the present invention.
Figure 2:
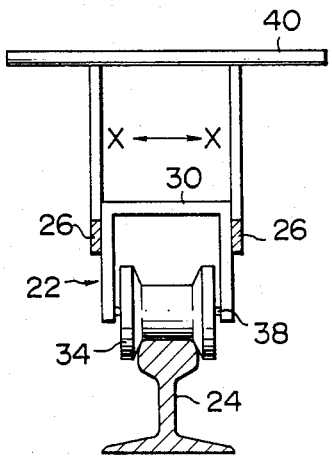
FIG. 2 is a sectional view taken along line II—II of FIG. 1.
Figure 3:
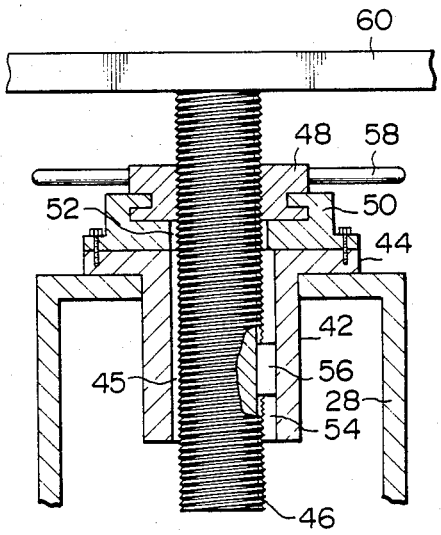
FIG. 3 is a sectional view taken along line III—III of FIG. 1.

Now, a build-up spraying apparatus according to the present invention will be described with reference to the accompanying drawings.

Referring to FIGS. 1 to 7 illustrating an embodiment of a build-up spraying apparatus according to the present invention, a build-up spraying apparatus generally designated by reference numeral 20 includes a truck 22 which is adapted to be traveled on a rail 24 to be subjected to build-up spraying. The truck 22 comprises a pair of chassis frames 26 extending in parallel to the rail 24, brackets 28 and 30 respectively mounted on the front and rear portions of the chassis frames 26, and wheels 32 and 34 rotatably mounted on the brackets 28 and 30 through axles 36 and 38, respectively. Each of the chassis frames 26 is upwardly bent at the rear portion thereof to form a rising portion, on the top end of which a handle 40 is fixedly supported to horizontally extend in the direction across the rail 24. The handle 40 serves to allow the truck 22 to be traveled on the rail 24 with a desired velocity when an operator pushes the truck 22 through the handle 40.

The truck 22 has a guide cylinder 42 fitted in the central portion of the front bracket 28 and fixedly mounted at the upper flange portion 44 on the bracket 28. The guide cylinder 42 has a vertical guide hole 45 formed therethrough, into which a screw 46 is inserted so as to be movable in the vertical direction. Reference numeral 48 designates a block member formed with a female screw which is engagedly fitted on the screw 46. The block 48 is supported by a block holder 50 so that the block 48 may be rotatable with respect to the screw 46 but may not be vertically moved. The block holder 50 is securely fixed on the upper flange portion 44 of the guide cylinder 42. The block holder 50 has a guide hole 52 formed therethrough so as to be vertically aligned with the guide hole 45 of the guide cylinder 42. The screw 46 is inserted through the guide hole 52 of the block holder 50 as well as the guide hole 45 of the guide cylinder 42. The guide hole 45 of the guide cylinder 42 is formed therein with a key way 54 vertically extending along the guide hole 45, in which a key 56 formed on the side surface of the screw 46 is fitted to allow the screw 46 to be vertically moved without rotating. The block 48 is provided with a handle 58, which acts to vertically move the screw 46 when it is turned to rotate the block 48. On the top of the screw 46, a base member 60 is horizontally mounted.

On the base member 60 are carried a vertically extending tank 62 for unifying the pressure of combustion promoting gas and a vertically extending tank 64 for unifying the pressure of fuel gas, as shown in FIG. 1. The combustion promoting gas tank 62 is supplied thereto combustion promoting gas such as oxygen through a main pipe 66 made of metal, and the fuel gas tank 64 is supplied thereto fuel gas such as acetylene, propane or the like through a main pipe 68 formed of metal. The combustion promoting gas tank 62 has a plurality of metal pipes 70 for distributing combustion promoting gas connected thereto through a plurality of flow control valves 72, through which combustion promoting gas is adapted to be fed to a build-up spraying torch or burner 74. The fuel gas tank 64 has a plurality of metal pipes 76 for distributing fuel gas connected thereto through a plurality of flow control valves 78, through which fuel gas is supplied to the build-up spraying burner 74. On the fuel gas tank 64 is mounted a pipe holder 80 upwardly extending therefrom, which acts to support a metal pipe 82 for supplying carrier gas therethrough. The supply pipe 82 serves to supply carrier gas for carrying build-up metal powder therethrough to a build-up metal powder supplying means 84 which will be described hereinafter. Inert gas such as argon or the like is preferably used as carrier gas which effectively prevents the oxidation of build-up metal powder.

The supply pipe 82 has a flow control valve 86 connected to the end thereof, and the build-up metal powder supplying means 84 is connected to the outlet of the flow control valve 86. The supplying means 84 has a hopper 88 mounted thereon which receives build-up metal powder therein. A predetermined amount of build-up metal powder is supplied from the hopper 88 through the supplying means 84 to a flow path of carrier gas and carried to the build-up spraying burner 74 by carrier gas. More particularly, the supplying means 84 is connected to the outlet thereof a metal pipe 90 for carrying build-up metal powder supplied from the hopper 88, through which build-up metal powder carried on carrier gas is supplied to the build-up spraying burner 74. Self-fluxing alloy powder having a low melting point may be used as build-up metal powder. Such self-fluxing alloy consists of, for example, Ni, Cr, Mo, B, Si and Fe. The build-up spraying apparatus of the present invention may employ metal powder having an average particle size of 150 $\mu$m. The smaller the particle size of build-up metal powder is, the more build-up metal powder may be readily controlled.

On the combustion promoting gas tank 62 is installed a device for controlling the supply of control gas or a control gas supply controlling device 92, which serves to positionally control the injection or spreading rate of build-up metal powder ejected from the build-up spraying burner 74 depending upon or in view of the injection direction of metal powder as desired. The device 92 has a control gas supply pipe 94 connected to the inlet thereof, to thereby carry out the supply of control gas. Inert gas such as argon or the like is preferably used as such control gas which prevents the oxidation of build-up metal powder. The control gas supply controlling device 92 is adapted to alternately deliver two systems of control gas in the form of pulses at a predetermined time width, to thereby positionally control the spreading or injection rate of build-up metal powder ejected from the build-up spraying burner 74 depending upon the injection direction of metal powder. The device 92 has two control gas supply pipes 96 and 98 respectively connected to two outlets thereof. The supply pipes 96 and 98 serve to supply to the build-up spraying burner 74 two systems of control gas of which the supply time width is determined.

Now, the build-up spraying burner 74 will be described in detail.

The build-up spraying burner 74 comprises a fluid control device 100 which serves to spread or dust build-up metal powder on the rail 24 to be subjected to build-up spraying in the direction X (FIG. 2) perpendicular to the traveling direction Y (FIG. 1) of the apparatus 20, heating burner bodies 102 for melting build-up metal powder ejected from the fluid control device 100 and heating the rail 24, and a cooler 104 for cooling the heating burner body 102; and is supported on the chassis frames 26 in a manner to be interposed therebetween. The build-up spraying burner 74 may be supported on the frames 26 by engaging the tip ends of threaded bolts 106 respectively inserted through the frames 26 with recesses (not shown) formed at the both sides of the burner 74 to securely interpose the burner between the frames and space the burner at a desired distance from the top surface of the rail 24, as schematically shown in FIG. 1. The heating burner bodies are arranged on the both sides based on the traveling direction of the apparatus 20 in a manner to interpose the fluid control device 100. In the illustrated embodiment, one pair of the heating burner bodies 102 is provided. The vertical position of the build-up spraying burner 74 is adjusted by removing the burner holding means or threaded bolts 106 from the burner to render the burner free and then rotating the handle 58 to vertically move the screw 46, to thereby vertically move the burner through the pressure unifying tanks 22 and 23, pipes 70, 76, 90, 96 and 98, etc. Lastly, the burner 74 is fixed on the truck 22 by means of the threaded bolts 106.

Figure 7:
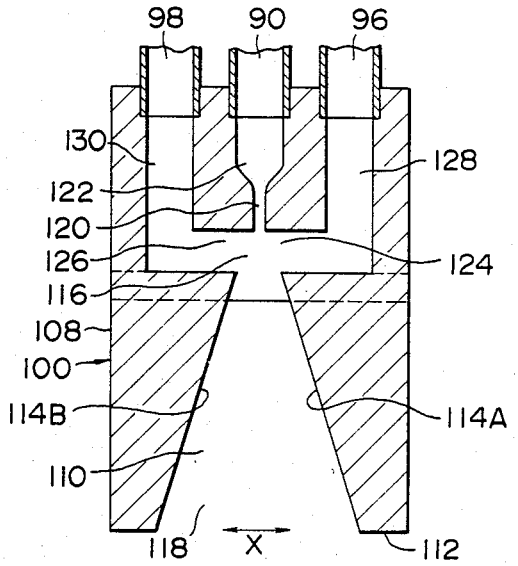
FIG. 7 is a vertical sectional view showing an example of a fluid control device employed in the build-up spraying apparatus shown in FIG. 1.

The fluid control device 100 for spreading or dusting build-up metal powder, as shown in FIG. 7, comprises a device body 108 having a slit 110 formed therein which is communicated through an opened end 112 thereof with the exterior. The slit 110 is formed to have a rectangle shape in cross section and have a pair of side walls 114A and 114B formed to allow the width in the spreading or dusting direction X of build-up metal powder to increase gradually from the interaction region 116 thereof to the outlet portion 118 thereof, as shown in FIG. 7. The remaining pair of side walls defining the slit 110 comprises the vertically extending wall portions of the heating burner bodies 102 arranged at the both sides of the fluid control device, except the interaction region 116.

The fluid control device 100 is formed with an injection nozzle 120 which is arranged above the inlet 116 of the slit 110 so as to be communicated at one end thereof with the interaction region 116 and serves to eject build-up metal powder into the slit 110. The injection nozzle 120 is also communicated at the other end thereof with a passage 122 formed in the fluid control device 100, and the passage 122 is connected at the inlet portion thereof to the metal powder supplying pipe 90.

The fluid control device 100 is also formed with a pair of control gas injection ports 124 and 126, which are arranged to interpose the interaction region 116 of the slit 110 therebetween in the spreading direction X. The control gas injection ports 124 and 126 are respectively communicated with passages 128 and 130 formed in the fluid control device 100, and the passages 128 and 130 are respectively connected thereto the control gas supply pipes 96 and 98, so that the two systems of control gas may be alternately supplied in a pulse-like manner at a predetermined time width from the control gas supply controlling device 92 to the fluid control device 100. When control gas for positionally controlling the spreading rate of build-up metal powder is ejected from the control gas injection port 124, build-up metal powder is forced toward the side wall 114B resulting in the spreading rate of metal powder being increased on the side of the side wall 114B and decreased on the side of the side wall 114A. Whereas, the injection of control gas from the control gas injection port 126 causes build-up metal powder to be forced toward the side wall 114A, so that the spreading rate of metal powder may be increased on the side near the side wall 114A and decreased on the opposite side. Thus, it will be noted that the positional control of spreading rate of build-up metal powder may be conducted utilizing two systems of control gas.

Figure 4:
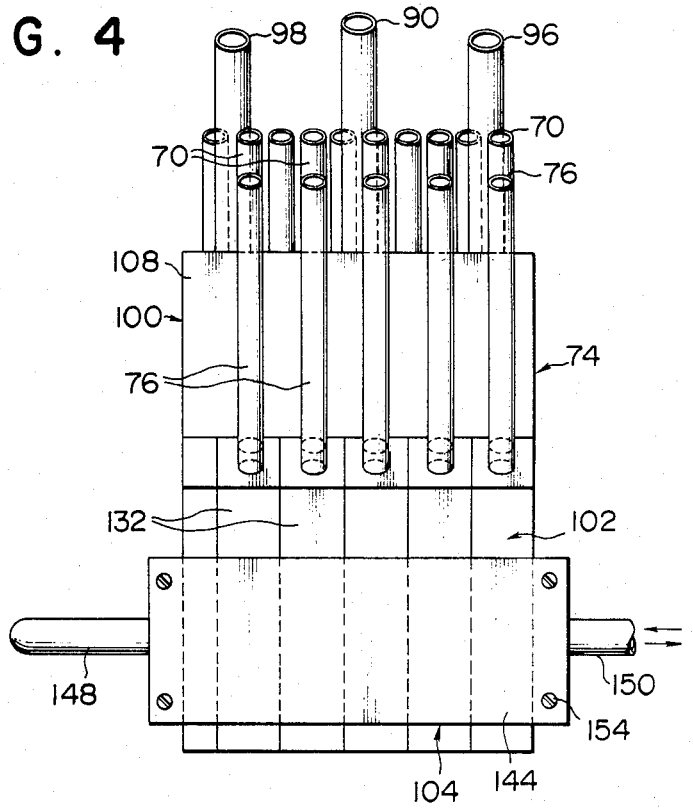
FIG. 4 is a front view showing an example of a build-up spraying burner employed in the build-up spraying apparatus shown in FIG. 1.
Figure 5:
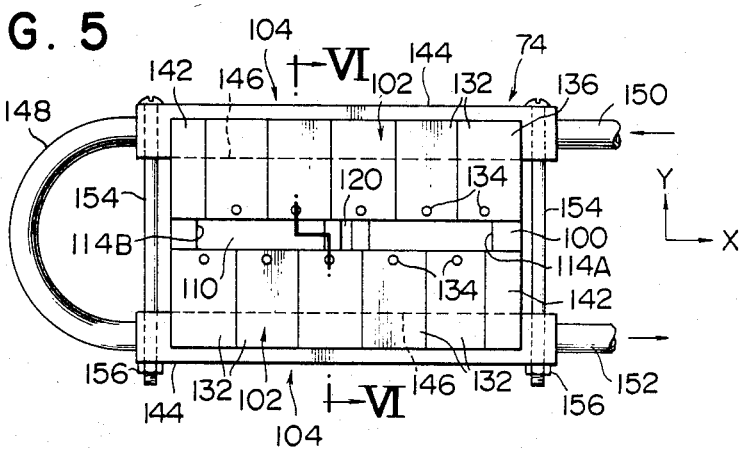
FIG. 5 is a bottom view of the build-up spraying burner shown in FIG. 4.

Each of the heating burner bodies 102 arranged on the both sides of the so-constructed fluid control device, as shown in FIGS. 4 and 5, has a plurality of single-hole nozzles 132 arranged in a row in the lateral direction so as to be contacted with each other and combined together by means of the clamping force of the cooler 104. The single-hole nozzles 132 each are formed therein with a single elongated hole 134 which is opened at the lower end of a nozzle body 136 of the nozzle 132, so that it is adapted to eject flame for melting build-up metal powder and heating the rail 34. The hole 134 is communicated with two passages 138 and 140 formed into a bifurcated shape. The upper ends of passages 138 and 140 are opened at the upper end of the nozzle body 136 and are respectively connected thereto the pipe 70 for distributing combustion promoting gas and the fuel gas distributing pipe 76. Combustion promoting gas such as oxygen and fuel gas such as acetylene respectively supplied through the pipes 70 and 76 to the nozzle 132 are combined with each other at the confluence between the passages 138 and 140 and ejected from the hole 134. In the present embodiment, the nozzles 132 of the respective rows provided to interpose the slit 110 therebetween are arranged in such a manner that the holes 134 of the nozzles of one row are positionally alternated with those of the nozzles of the other row with the slit 110 interposed therebetween. This results in the ends of the heating burner bodies being uneven. In view of this respect, a dummy nozzle body 142 is disposed at one end of each heating burner body to allow the both heating burner bodies to be aligned with each other. In the build-up spraying burner 74 constructed in the manner as described above, flame ejected from the holes 134 of the nozzles 132 serves to melt build-up metal powder ejected from the slit 110 and the surface of the rail 24 to be subjected to build-up spraying, so that the molten metal powder is deposited on the surface of the rail 24 to form build-up. In this instance, the combustion promoting gas supply pipes 70 and fuel gas supply pipes 76 are respectively provided with the flow control valves 27 and 30 to independently control the flow rates of the respective gases to be fed to the holes 134 as described above, thus, the build-up spraying apparatus of the embodiment may effectively adjust the quantity of heat to be applied to the metal powder and rail depending upon the difference in the spreading or dusting rate of build-up metal powder in the spreading direction X.

Figure 6:
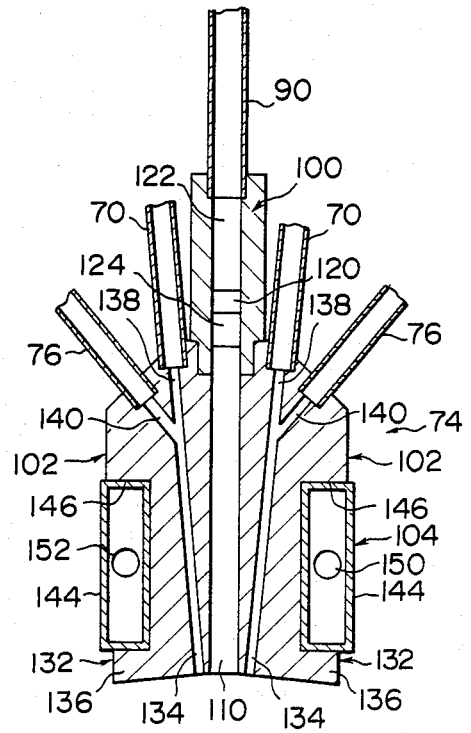
FIG. 6 is a sectional view taken along line VI—VI of FIG. 5.

The cooler 104, as shown in FIGS. 4 to 6, comprises a pair of water cooling jackets 144 fixedly fitted in recesses 146 formed at the side walls of the respective heating burner bodies 102, a metal communication pipe 148 connected between the water cooling jackets 144 to communicate the jackets with each other, a water supply pipe 150 connected to one of the water cooling jackets 144, and a drain pipe 152 connected to the other water cooling jacket 144. In the embodiment, the water cooling jackets 144 are connected together in a manner to interpose the burner bodies 102 and the fluid control device 100 therebetween by means of connecting bolts 154 and nuts 156, so that the burner bodies 102 and fluid control device 100 are integrally assembled.

Now, the manner of operation of the build-up spraying apparatus 20 constructed as described above will be described with reference to the drawings.

The build-up spraying apparatus 20 is transported to a place where the rail 24 is to be subjected to build-up spraying and is set on the rail by putting the wheels 32 and 34 of the truck 22 on the rail 24. In the embodiment illustrated, the setting of the apparatus 20 is carried out by only putting the apparatus on the rail 24 without fixing it on the rail, and the removal of the apparatus after the build-up spraying is carried out by lifting the apparatus and laterally moving it. Thus, it will be noted that the build-up spraying apparatus 20 may be readily applied to the rail. Then, a mixed gas of fuel gas and combustion promoting gas is ejected from the holes 134 of the heating burner bodies 102 in the build-up spraying burner 74 and ignited to form combustion flame, which serves to melt build-up metal powder ejected from fluid control device 100 and to deposit the molten metal powder, to thereby form build-up. At this time, the control gas of the two systems supplied from the control gas supply controlling device 92 to the fluid control device 100 is alternately ejected in the form of pulses from the control gas injection ports 124 and 126 provided at the both sides of the injection nozzle 120 depending upon the portion and state of the rail 24 to be subjected to build-up spraying to positionally control the spreading or dusting rate of build-up metal powder in the spreading direction X.

Figure 8:
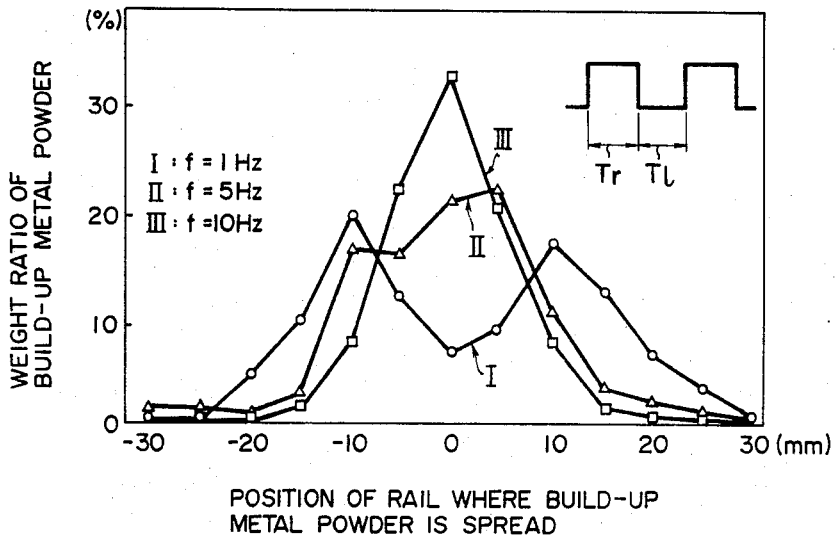
FIG. 8 is a graphical representation showing the distribution characteristics of spreading rate of build-up metal powder in the fluid control device shown in FIG. 7 which are obtained when the switching frequency of control gas is varied.
Figure 9:
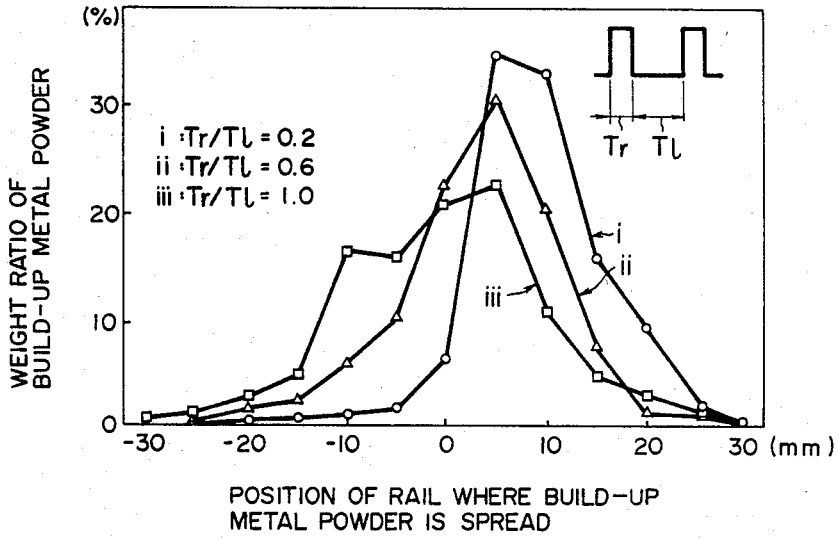
FIG. 9 is a graphical representation showing the distribution characteristics of spreading rate of build-up metal powder in the fluid control device of FIG. 7 which are obtained when varying the ratio in pulse-like injection time of control stream.

In this instance, the fluid control device 100 exhibits metal powder spreading distribution characteristics as shown in FIG. 8, when the switching frequency of the control gas is varied. In FIG. 8, the axis of abscissas indicates the position at which build-up metal powder is spread or dusted and the axis of ordinates indicates the weight ratio of build-up metal powder spread or the ratio between the weight of spread powder metal at each spreading position and the total weight of spread metal powder. Also, in FIG. 8, I indicates the distribution characteristics of spreading rate at a switching frequency of 1 Hz, and II and III respectively designate the spreading distribution characteristics at the frequencies of 5 Hz and 10 Hz. The results of FIG. 8 were obtained under the conditions that the injection time $T_r$ of control gas ejected in the form of pulses on the right side in the spreading or dusting direction X in FIG. 7 is equal to the injection time $T_l$ of that on the left side, the slit 110 is 30 degree in angle of aperture, the nozzle 120 has a width of 4 mm, the control gas injection ports 124 and 126 each have a width of 8 mm, a main jet of build-up metal powder and carrier gas is ejected at a flow rate of 2 l/min, and the control stream of control gas is ejected at a flow rate of 14 l/min. The switching of main jet from the side of the side wall 114A to the side of the side wall 114B by the control stream requires a certain period of time. The ratio at which the switching time occupies in one cycle becomes large with the increase of the switching frequency. Build-up metal powder is predominantly spread on the center line of the fluid control device 100 in the spreading direction X during the switching time of the main jet. Thus, as the switching frequency is increased, the spreading distribution characteristics of the fluid control device 100 are as shown by line III in FIG. 8 which has a convex portion at the central section. In order to obtain a uniform spreading distribution of the metal powder using the apparatus 20, switching frequency of about 5 Hz is required. The spreading distribution suitable for repairing partial or local wear of the rail is obtained by varying the ratio between the pulse-like injection time $T_r$ of control stream on the right side and the pulse-like injection time $T_l$ of that on the left side. FIG. 9 shows an example of spreading distribution characteristics of the fluid control device 100 measured by varying the ratio between $T_r$ and $T_l$ In FIG. 9, the axis of abscissas indicates a position at which build-up metal powder is spread and the axis of ordinates indicates the ratio between the weight of build-up metal powder, spread at each position and the total weight of spread metal powder. Also, in FIG. 9, line i designates spreading distribution characteristics of the fluid control device 100 at the ratio $T_r/T_l$ of 0.2, and lines ii and iii respectively indicate the spreading distribution characteristics in the case that the ratio is 0.6 and 1.0. The decrease in the ratio of $T_r$ to $T_l$ causes build-up metal powder to be predominantly spread on the side to which the metal powder is forced by the control stream of a longer period of injection time, as shown by line i in FIG. 9. Thus, it will be noted that any partial or local wear of the rail may be readily repaired by suitably setting the ratio between the pulse-like injection time $T_r$ of control stream on the right side and that $T_l$ on the left side depending upon the degree of partial wear.

After build-up of a desired thickness is formed on the rail 24 by spraying, the truck 22 is moved on the rail to another portion of the rail to be subjected to build-up spraying.

In the illustrated embodiment, the truck 22 is adapted to be manually moved, however, the build-up spraying apparatus 20 may be constructed to automatically move the truck 22 on the rail 24 by means of a motor.

Figure 10:
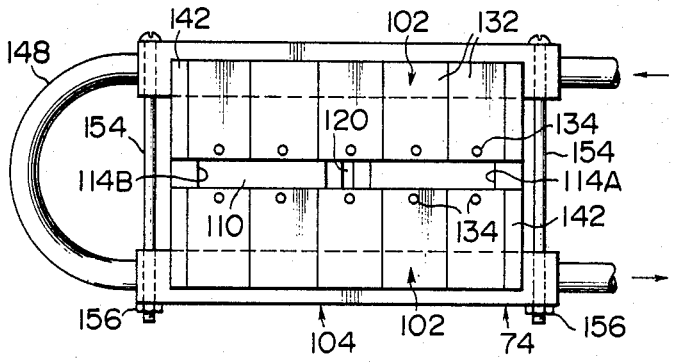
FIG. 10 is a bottom view showing another example of a build-up spraying burner adapted to be used in the build-up spraying apparatus of FIG. 1 wherein a plurality of single-hole nozzles are arranged in a manner different from the burner shown in FIG. 4.

Further, in the illustrated embodiment, the nozzles 132 of the respective rows disposed to interpose the slit 110 therebetween are arranged in the manner that the flame holes 134 of the nozzles 132 of one row are positionally alternated with those of the nozzles 132 of the other row with the slit 110 interposed therebetween. However, the nozzles 132 of the two rows may be arranged in such a manner that the flame holes 134 of one row are opposite to those of the other row, as shown in FIG. 10.

Furthermore, the single-hole nozzle 132 of each row may be connected together by tightening a bolt inserted therethrough with a nut.

Figure 11:
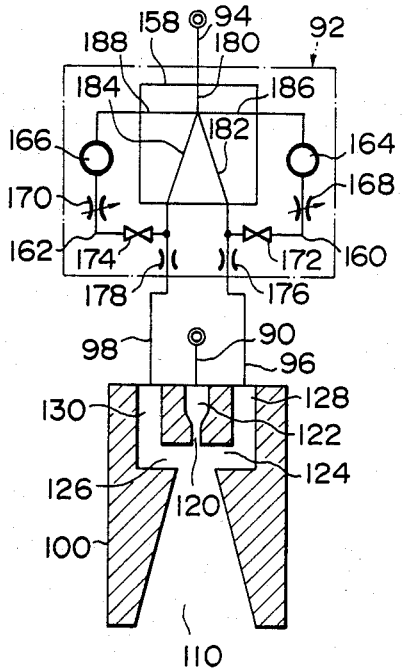
FIG. 11 is a fluid circuit diagram showing an example of a control gas supply controlling device.

The control gas supply controlling device 92, as shown in FIG. 11, may be formed by a feedback oscillating circuit utilizing a flip-flop type fluidic device. More particularly, the control gas supply controlling device of FIG. 11 comprises a flip-flop fluidic device 158, a pair of feedback pipes 160 and 162 connected to the both sides of the fluidic device 158, tanks 164 and 166 respectively connected to the feedback pipes 160 and 162, variable throttle valves 168 and 170 and stop valves 172 and 174, and fixed restrictors 176 and 178 respectively connected to the control gas supply pipes 96 and 98. The fluidic device 158 also includes an inlet passage 180 connected to the control gas supply pipe 94 and two output passages 182 and 184 diverged from the inlet passage 180 and respectively connected through the fixed restrictors 176 and 178 to the control gas supply pipes 96 and 98. The output passage 182 is also connected at the outlet thereof through the feedback pipe 160 to a control passage 186 of the fluidic device 158, whereas the output passage 184 is connected at the outlet thereof through the feedback pipe 162 to a control passage 188 of the fluidic device 158. The input passage 180, output passages 182 and 184, and control passages 186 and 188 are communicated with one another within the fluidic device 158.

The control gas supply controlling device 92 comprising the feedback oscillating circuit constructed as described above can adjust the outflow time of each of the output streams on the both sides of the oscillating circuit or the inlet time of each of the control streams on the both sides of fluid control device 100 for spreading build-up metal powder by varying the opening of the variable throttle valves 168 and 170 each acting as a means for adjusting the injection time of control gas and/or the volume of the tanks 164 and 166 to change the oscillating frequency and/or pulse width of the oscillating circuit. When the output of the control stream is small, it is required to increase the flow rate of the control stream to the fluid control device 100. This is carried out, for example, by connecting a fluid control device for amplification between the oscillating circuit and the fluid control device 100. Also, the output streams on the both sides of the fluid control device 100 may be manually controlled by operating the stop valves 172 and 174.

Figure 12:
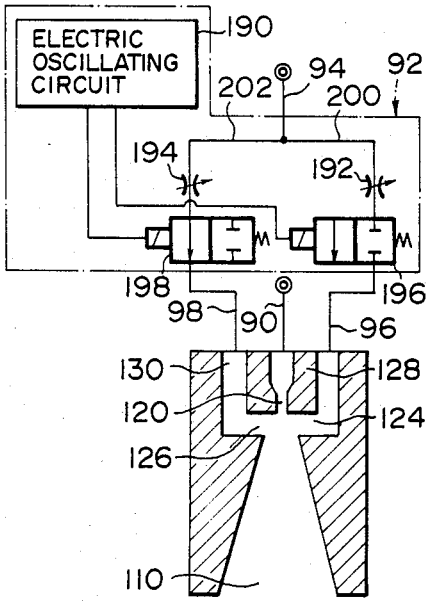
FIG. 12 is a fluid circuit diagram showing another example of a control gas switching cycle setting means.

Alternatively, the control gas supply controlling device 92 may be constructed in such a manner as shown in FIG. 12. More particularly, the control gas supply controlling device 92 of FIG. 12 comprises an electric oscillating circuit 190, two variable throttle valves 192 and 194 each acting as a gas pressure adjusting means, and two solenoid valves 196 and 198 each acting as a switching valve. In the control supply controlling device 92 of FIG. 12, the control gas supply pipe 94 is connected at the outlet thereof to a pair of branched control gas supply pipes 200 and 202, to which the variable throttle valves 192 and 194 and the solenoid valves 196 and 198 are connected in turn, respectively. The solenoid valves 196 and 198 are respectively connected at the outputs thereof to the control gas supply pipes 96 and 98. Such construction of the control gas supply controlling device 92 allows the solenoid valves 196 and 198 to be alternately operated by a signal supplied from the electric oscillating circuit 190, so that the control gas may be alternately supplied to the control gas injection ports 124 and 126 on the both sides of the fluid control device 100. In this instance, the time of supplying each of the two systems of control gas on the both sides of the device 100 may be varied by varying the oscillating frequency or pulse width of a signal supplied from the electric oscillating circuit 190 to adjust the inlet time of the two systems of control gas on the both sides of the fluid control device 100, as in the control gas supply controlling device 92 shown in FIG. 11. Alternatively, the flow rate may be varied by adjusting the variable throttle valves 192 and 194 respectively arranged at the upstreams of the solenoid valves 196 and 198 to allow the two systems of control gas to be supplied under pressures different from each other. The latter allows the spreading distribution of build-up metal powder suitable for repairing any partial wearing of a rail to be obtained, as in FIG. 11 adapted to vary the inlet times of the control gases on the both sides of the fluid control device.

Figure 13:
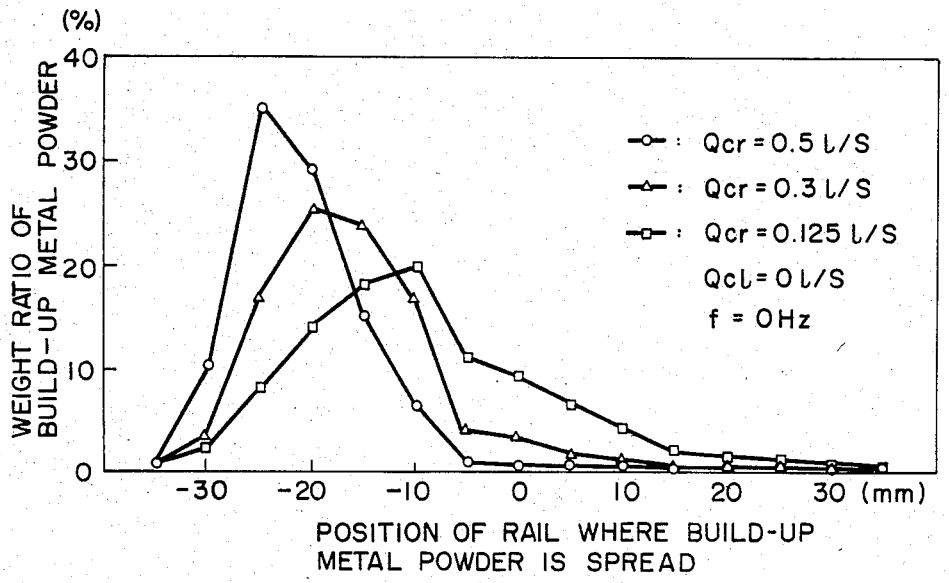
FIGS. 13 and 14 each are a graphical representation showing the distribution characteristics of spreading rate of build-up metal powder in the control gas supply controlling device shown in FIG. 12.
Figure 14:
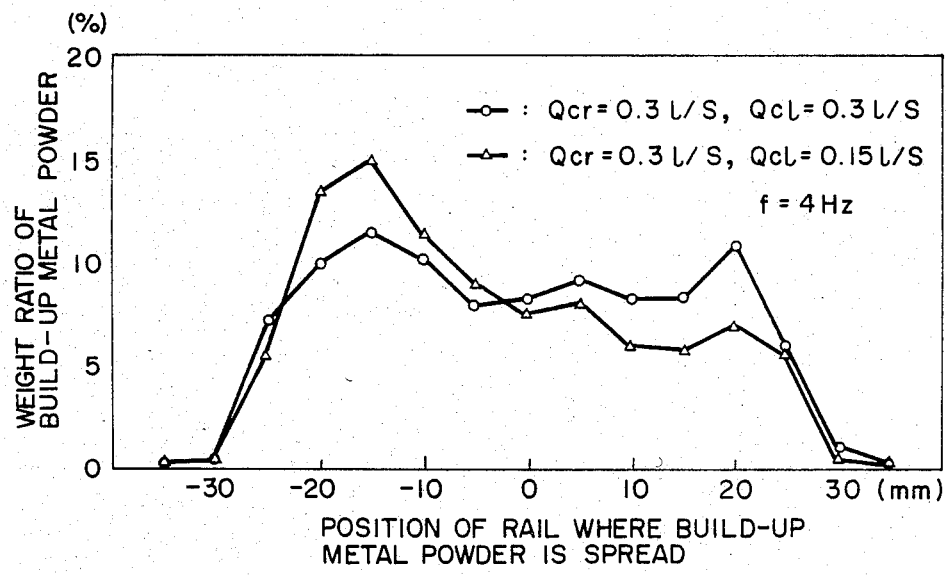

FIGS. 13 and 14 each show the spreading distribution of build-up metal powder obtained by the control gas supply controlling device 92 shown in FIG. 12. FIG. 12 shows the characteristics of spreading distribution obtained by closing the variable throttle valve 192 and then adjusting the variable throttle valve 194 while opening the solenoid valve 198 not to discharge control gas from the control gas injection port 124 ($Q_{cr}=0$ l/s), to thereby eject control gas from the control gas injection port 126 at the flow rates of 0.5, 0.3 and 0.125 l/s. FIG. 13 shows the characteristics of spreading distribution obtained by adjusting the variable throttle valves 192 and 194 together to allow two systems of control gas to be ejected from the control gas injection ports 124 and 126 at flow rates $Q_{cr}$ of 0.3 and 0.3 l/s and flow rates $Q_{cl}$ of 0.3 and 0.15 l/s and alternately operating the solenoid valves 196 and 198 at a frequency of 4 Hz by means of a signal from the electric oscillating circuit 190. Thus, it will be readily noted that the control gas supply controlling device 92 of FIG. 12 may provide the spreading distribution of build-up metal powder suitable for any partial or local wearing of a rail to be repaired.

Such spreading distribution of build-up metal powder may be obtained by pneumatic directional control valves which are operated utilizing a pressure of gas such as air, instead of the solenoid valves 196 and 198 and operating the valves by means of a signal supplied from a pneumatic oscillator.

The heating burner body 102 may be constructed by forming a common single nozzle body with a plurality of flame holes 134 independent from each other. Also, in the embodiment described above, the heating burner body is provided on each of the both sides of the fluid control device 100. However, the heating burner body may be provided on only one side of the device.

Further, the build-up spraying apparatus may be constructed in such a manner that the fuel gas supply pipes 70 and combustion promoting gas supply pipes 76 are respectively divided into groups corresponding to groups each consisting of at least two flame holes 134 adjacent to each other and the control valves 72 and 78 are respectively provided every group, so that the flow control may be carried out for every group.

As can be seen from the foregoing, the build-up spraying apparatus according to the present invention is constructed in the manner that the control gas supply controlling device alternately supplies the two systems of control gas in a pulse-like manner to the fluid control device having the control gas injection ports provided on the both sides thereof to adjust the cycle, pulse width or gas pressure of each of the two systems of control gas, to thereby control the spreading or dusting rate of build-up metal powder in the spreading direction as desired, thus the present invention is capable of forming partial or local build-up as well as uniform build-up as desired. Also, in the build-up spraying apparatus of the present invention, the gas supply line for supplying gases to the flame holes is provided with the flow control valves every flame hole or every group consisting of at least two flame holes adjacent to each other, so that the heating of build-up metal powder may be controlled in view of the difference in spreading rate of the metal powder in the spreading direction. Thus, the present invention is capable of ensuring satisfactory melting of the metal powder even when the spreading distribution is varied. Furthermore, in the present invention, the build-up spraying burner is carried on the truck, so that the build-up spraying operation may be started by merely putting the apparatus of the present invention on an article to be subjected to build-up spraying. Thus, the formation of build-up on, for example, a rail can be effectively carried out even in the intervals of train service.

It is a matter of course that the present invention is effectively applicable to other articles than a rail.

While preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A build-up spraying apparatus comprising a truck adapted to travel on an article to be subjected to build-up spraying and a build-up spraying burner supported on said truck to carry out build-up spraying with respect to said article, wherein said build-up spraying burner comprises:

a fluid control device for spreading build-up metal powder, said fluid control device being adapted to eject build-up metal powder together with carrier gas toward said article to spread build-up metal powder in the direction perpendicular to the traveling direction of said apparatus;

a device for controlling the supply of control gas so as to alternately supply to said fluid control device two systems of control gas in a pulse-like manner which act to positionally control the spreading rate of build-up metal powder in the spreading direction; and at least one heating burner body for heating build-up metal powder ejected from said fluid control device, said heating burner body being adapted to vary the amount of heat according to the difference in injection rate of build-up metal powder in the spreading direction.

2. A build-up spraying apparatus as defined in claim 1, wherein said fluid control device has a slit for spreading build-up metal powder therefrom formed therein and opened at the outlet thereof, said slit being formed to allow the width in the spreading direction to extend from the inlet thereof to the outlet thereof; a build-up metal powder injection nozzle for ejecting build-up metal powder into said slit provided at the inlet of said slit so as to be opposite to said slit; and a pair of control gas injection ports formed on the both sides of the inlet of said slit along the spreading direction of build-up metal powder to eject said two systems of control gas supplied from said control gas supply controlling device to positionally control the spreading rate of build-up metal powder in the spreading direction.

3. A build-up spraying apparatus as defined in claim 2, wherein said heating burner body is formed therein with a plurality of flame holes each of which is opened at the lower end thereof, said flame holes being arranged in a row in the spreading direction and connected thereto supply lines for fuel gas and combustion promoting gas which are provided with flow control valves.

4. A build-up spraying apparatus as defined in claim 3, wherein said flow control valve is provided every flame hole.

5. A build-up spraying apparatus as defined in claim 3, wherein said flame holes are divided into groups each consisting of at least two flame holes adjacent to one another, and said flow control valve is provided every flame hole group.

6. A build-up spraying apparatus as defined in claim 3, wherein said heating burner body is disposed on each of both sides of said fluid control device in the direction perpendicular to the spreading direction of build-up metal powder with said slit being interposed between said heating burner bodies.

7. A build-up spraying apparatus as defined in claim 6, wherein said heating burner body comprises a plurality of single-hole nozzle bodies arranged in a row.

8. A build-up spraying apparatus as defined in claim 1, wherein said control gas supply controlling device comprises a means for varying the cycle of each of said two systems of control gas.

9. A build-up spraying apparatus as defined in claim 1, wherein said control gas supply controlling device comprises a means for varying the pulse width of each of said two systems of control gas.

10. A build-up spraying apparatus as defined in claim 1, wherein said control gas supply controlling device comprises a means for varying the gas pressure of each of said two systems of control gas.

11. A build-up spraying apparatus as defined in claim 8, wherein said control gas supply controlling device comprises a feedback oscillating circuit utilizing a fluidic device of the flip-flop type, said feedback oscillating circuit being provided at each of both feedback passages thereof with a means for adjusting the injection time of control gas which comprises a variable throttle valve and a tank.

12. A build-up spraying apparatus as defined in claim 9, wherein said control gas supply controlling device comprises a feedback oscillating circuit, said feedback oscillating circuit being provided at each of both feedback passages thereof with a means for adjusting the injection time of control gas which comprises a variable throttle valve and a tank.

13. A build-up spraying apparatus as defined in claim 8, wherein said control gas supply controlling device comprises a gas pressure adjusting means connected to each of two systems of passages, a solenoid valve connected to each of said two systems of passages, and an electric oscillating circuit which is adapted to vary at least one of an oscillating frequency and a pulse width to adjust the switching time of said both solenoid valves.

14. A build-up spraying apparatus as defined in claim 9, wherein said control gas supply controlling device comprises a gas pressure adjusting means connected to each of two systems of passages, a solenoid valve connected to each of said two systems of passages, and an electric oscillating circuit which is adapted to vary at least one of an oscillating frequency and a pulse width to adjust the switching time of said both solenoid valves.

15. A build-up spraying apparatus as defined in claim 10, wherein said control gas supply controlling device comprises a gas pressure adjusting means connected to each of two systems of passages, a solenoid valve connected to each of said two systems of passages, and an electric oscillating circuit which is adapted to vary at least one of an oscillating frequency and a pulse width to adjust the switching time of said both solenoid valves.

16. A build-up spraying apparatus as defined in claim 8, wherein said control gas supply controlling device comprises a gas pressure adjusting means connected to each of two systems of passages, a pneumatic directional control valve connected to each of said two systems of passages, a pneumatic oscillator adapted to vary at least one of an oscillating frequency and a pulse width to adjust the switching time of said both switching valves.

17. A build-up spraying apparatus as defined in claim 9, wherein said control gas supply controlling device comprises a gas pressure adjusting means connected to each of two systems of passages, a pneumatic directional control valve connected to each of said two systems of passages, a pneumatic oscillator adapted to vary at least one of an oscillating frequency and a pulse width to adjust the switching time of said both solenoid valves.

18. A build-up spraying apparatus as defined in claim 10, wherein said control gas supply controlling device comprises a gas pressure adjusting means connected to each of two systems of passages, a pneumatic directional control valve connected to each of said two systems of passages, a pneumatic oscillator adapted to vary at least one of an oscillating frequency and a pulse width to adjust the switching time of said both solenoid valves.

19. A build-up spraying apparatus comprising a truck adapted to travel on an article to be subjected to build-up spraying and a build-up spraying burner supported on said truck to carry out build-up spraying with respect to said article, wherein said build-up spraying burner comprises:

a fluid control device for spreading build-up metal powder, said fluid control device being adapted to eject build-up metal powder together with carrier gas toward said article to spread build-up metal powder in the direction perpendicular to the traveling direction of said apparatus;

a device for controlling the supply of control gas so as to alternately supply to said fluid control device two systems of control gas in a pulse-like manner which act to positionally control the spreading rate of build-up metal powder in the spreading direction;

at least one heating burner body for heating build-up metal powder ejected from said fluid control device, said heating body being adapted to vary the amount of heat according to the difference in injection rate of build-up metal powder in the spreading direction;

said fluid control device having a slit for spreading build-up metal powder therefrom formed therein and opened at the outlet thereof, said slit being formed to allow the width in the spreading direction to extend from the inlet thereof to the outlet thereof; a build-up metal powder injection nozzle for ejecting build-up metal powder into said slit provided at the inlet of said slit so as to be opposite to said slit; and a pair of control gas injection ports formed on both sides of the inlet of said slit along the spreading direction of build-up metal powder to eject said two systems of control gas supplied from said control gas supply controlling means to positionally control the spreading rate of build-up metal powder in the spreading direction;

said heating burner body being formed therein with a plurality of flame holes each of which is opened at the lower end thereof, said flame holes being arranged in a row in the spreading direction and connected thereto supply lines for fuel gas and combustion promoting gas which are provided with flow control valves.

* * * * *